US006624795B2

(12) United States Patent
Boyle

(10) Patent No.: US 6,624,795 B2
(45) Date of Patent: Sep. 23, 2003

(54) ANTENNA ARRANGEMENT

(75) Inventor: Kevin R. Boyle, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/015,707

(22) Filed: Nov. 30, 2001

(65) Prior Publication Data

US 2002/0080088 A1 Jun. 27, 2002

(30) Foreign Application Priority Data

Dec. 16, 2000 (GB) ..... 0030741

(51) Int. Cl.[7] ..... H01Q 1/36
(52) U.S. Cl. ..... 343/895; 343/702
(58) Field of Search ..... 343/702, 895, 343/893; H01Q 1/38, 1/36

(56) References Cited

U.S. PATENT DOCUMENTS

| | | | | | |
|---|---|---|---|---|---|
| 4,335,385 | A | | 6/1982 | Hall | 343/700 |
| 5,635,945 | A | * | 6/1997 | McConnell et al. | 343/895 |
| 5,990,847 | A | * | 11/1999 | Filipovic et al. | 343/895 |
| 6,023,251 | A | | 2/2000 | Koo et al. | 343/895 |
| 6,236,378 | B1 | * | 5/2001 | Van Loon | 343/895 |
| 6,351,241 | B1 | * | 2/2002 | Wass | 343/702 |
| 6,400,339 | B1 | * | 6/2002 | Edvardsson et al. | 343/895 |
| 6,407,720 | B1 | * | 6/2002 | Josypenko | 343/895 |

FOREIGN PATENT DOCUMENTS

| | | | |
|---|---|---|---|
| EP | 0923153 A1 | 6/1999 | H01Q/1/36 |
| WO | WO9749141 | 12/1997 | H01Q/1/36 |

* cited by examiner

*Primary Examiner*—Hoanganh Le
(74) *Attorney, Agent, or Firm*—Jack D. Slobod

(57) ABSTRACT

An antenna arrangement comprises a folded structure (100) comprising first and second sections (102, 104) defining a transmission line. The sections may be meander-line elements or other physically-shortened electric elements, for example a helical element. Respective feed points (103, 105) are provided at the free ends of the sections (102, 104), thereby enabling independent connections to be made for different modes, such as transmit and receive. Top-loading and additional short-circuit elements may be provided to improve performance and reduce antenna volume. The impedances of the sections (102, 104) may be arranged to differ by adjusting conductor width or by fabricating one of the sections as a plurality of conductors connected in parallel. Discrete components may be included within the antenna structure, to provide enhanced design possibilities, while multi-band operation is enabled by fabrication of additional folded structures within the same volume.

16 Claims, 4 Drawing Sheets

ANTENNA ARRANGEMENT

BACKGROUND OF THE INVENTION

1. Field of the Invention

The present invention relates to an antenna arrangement employing a folded structure having first and second sections defining a transmission line and to a radio communications apparatus incorporating such an arrangement.

2. Description of the Related Art

Terminals for use in radio communication systems are increasingly becoming smaller and smaller, for example cellular phone handsets. Hence, there is a need to provide smaller antennas without sacrificing radiation performance or efficiency. A further requirement is to provide antennas capable of operating in a range of different radio systems, for example GSM (Global System for Mobile communications), UMTS (Universal Mobile Telecommunication System) and Bluetooth.

A range of compact antenna arrangements are known, for example helical and meander-line antennas, the latter as disclosed for example in International Patent Application WO 97/49141.

SUMMARY OF THE INVENTION

An object of the present invention is to provide an improved compact antenna.

According to a first aspect of the present invention there is provided a antenna arrangement comprising a folded structure having first and second sections defining a transmission line, wherein each of the first and second sections comprises a physically-shortened electric element having a respective feed point at its free end.

The first and second sections need not be exactly parallel, for example they could define a tapered transmission line. Similarly, the first and second sections need not be exactly symmetrical, but do need to take approximately the same route so that a transmission line is defined.

Such an arrangement enables the use of one feed point for each operational mode. Different operational modes may consist of transmit and receive functions, different systems (for example GSM and UMTS), different frequency bands, or any combination of these modes. By the use of a separate feed point for each mode, it is significantly easier to provide optimal loading and efficiency in all modes.

Top loading may be provided between the first and second sections, thereby improving antenna performance and providing a more uniform current distribution through the folded structure. Additional short circuit elements may be used to modify the impedance of the arrangement.

The relative impedance presented by the feeds may be altered by arranging for the conductors of the first and second sections to be of different width, or by arranging for one of the sections to comprise a plurality of conductors connected in parallel.

The antenna arrangement may include discrete components, particularly if it is fabricated on a substrate such as PCB or LTCC. Such components may vary the current distribution on the folded structure, or may implement a switching function.

Multi-band operation may be enabled by duplication of the folded structure, at a reduced scale, within the same volume.

According to a second aspect of the present invention there is provided a radio communications apparatus including an antenna arrangement made in accordance with the present invention.

The present invention is based upon the recognition, not present in the prior art, that by folding a meander-line or other physically-shortened electric antenna, improved performance can be provided in a reduced volume.

BRIEF DESCRIPTION OF THE DRAWINGS

Embodiments of the present invention will now be described, by way of example, with reference to the accompanying drawings, wherein.

In the drawings the same reference numerals have been used to indicate corresponding features.

DESCRIPTION OF THE PRESENTLY PREFERRED EMBODIMENTS

Figure 1:
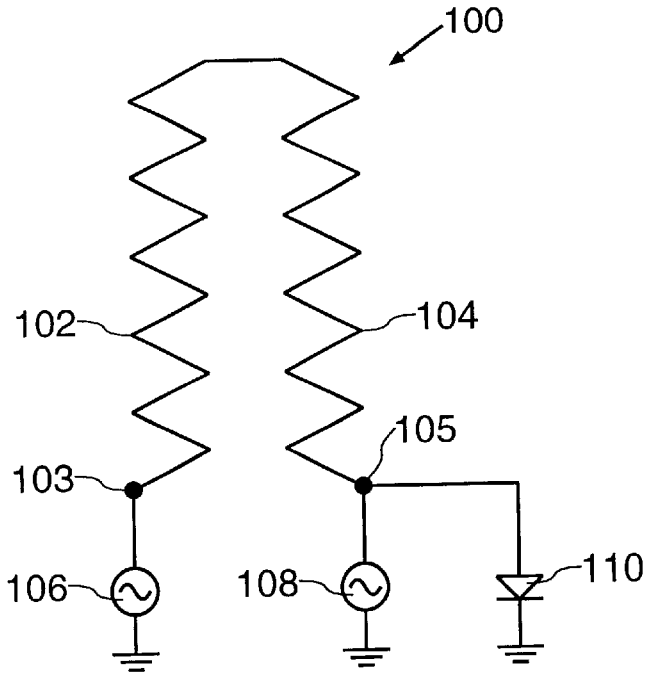
FIG. 1 shows a basic antenna arrangement made in accordance with the present invention.

Referring to FIG. 1, a basic embodiment of the present invention comprises a folded antenna 100 comprising first and second meander-line sections 102, 104. The sections 102, 104 shown are of a "zig-zag" type, but other forms are possible, for example helical or square-wave (the latter as shown in WO 97/49141). The main criteria for design of the meander lines is that the horizontal components of current (i.e., those perpendicular to the axes of the sections 102, 104) cancel while the vertical components of current do not. The antenna does not have to be completely symmetric provided that both sides 102, 104 of the fold take approximately the same route, thereby defining a transmission line. The reasons for this requirement will be apparent from the following description First and second feed points 103, 105 are provided at the free ends of the first and second sections 102, 104 respectively, fed by signals from first and second sources 106, 108. When the first source 106 is in use the second source 108 is connected to ground by a diode 110. Similarly, when the second source 108 is in use the first source is connected to ground by switching means (not shown) The switching could be accomplished by a range of alternatives to the diode 110, for example an on-chip transistor or even by a passive LC resonant circuit or similar if the sources 106, 108 operate at different frequencies.

The configuration shown in FIG. 1 allows use of cheap, low-distortion switches, as disclosed in our co-pending unpublished United Kingdom patent application 0025709.7 (applicant's reference PHGB000145). The antenna may also be provided with multiple feeds, thereby enabling operation with a distributed multiplexer, as disclosed in our co-pending unpublished International patent application PCT/EPO1/06760 (applicant's reference PHGB000083).

The electrical behaviour of the folded antenna 100 can be considered as a superposition of unbalanced currents, flowing in the same direction in the two sections 102, 104, and balanced currents, flowing in opposite directions in the two sections 102, 104. Radiation is only generated by the unbalanced currents. The impedance of the radiating mode is approximately four times the impedance of an unfolded structure of the same total length, typically allowing the low impedance of a short antenna to be transformed to around 50 Ohms. The impedance of the balanced mode is approximately twice that of a short circuit transmission line of appropriate length.

The total impedance presented by the antenna 100 is the parallel combination of the impedances of the two modes. By making the overall electrical length of each section 102, 104 less than a quarter of a wavelength, the impedance of the balanced mode is that of a short circuit stub having a length of less than a quarter of a wavelength, namely inductive. This impedance can therefore be used to tune out the capacitive reactance of the balanced mode.

The basic embodiment therefor provides a compact antenna, having a shorter length than an equivalent unfolded antenna and supporting efficient switching and multiple-frequency operation (via multiple feeds). It would typically be implemented as a printed structure, either as part of an existing circuit board in a radio transceiver or as a separate module. By having independent feeds for each mode (for example transmission and reception), the antenna can be made narrower band, and therefore smaller, while the design of matching circuits is simplified.

Figure 2:
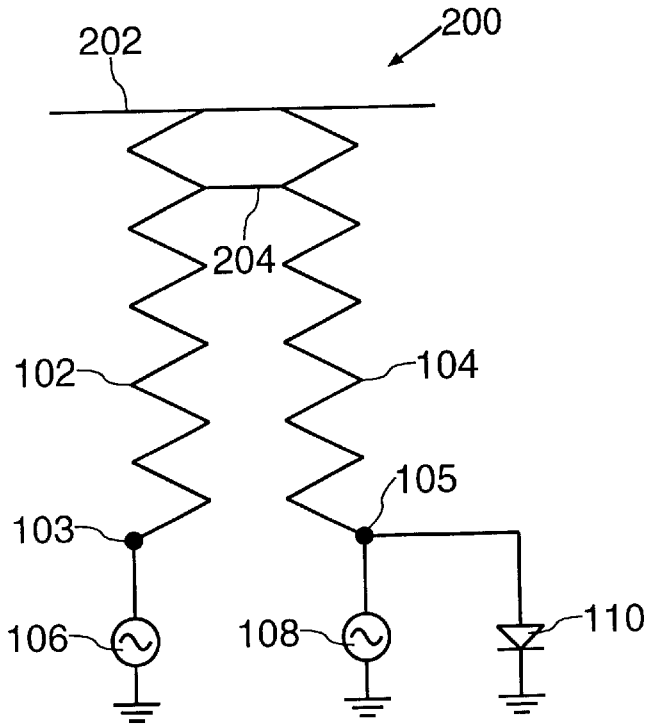
FIG. 2 shows an antenna arrangement having top loading in accordance with the present invention.

New possibilities are also provided by the use of a printed structure. FIG. 2 shows an embodiment in which an antenna 200 is further shortened by the addition of top loading 202, which as is well known improves the antenna impedance and gives a more uniform current distribution.

A short circuit 204 is also provided between the sections 102, 104, thereby altering the impedance of the balanced mode (by changing the length of the short circuit stub) without affecting the performance of the radiating mode (since corresponding points on each of the two sections 102, 104 of the antenna are at the same potential in the radiating mode). Hence, the feed impedance can readily be adjusted to a convenient value by adjusting the location of the short circuit 204.

The antenna impedance at the feeds can also be altered in other ways. One is by the addition of independent matching circuitry at each feed point 103, 105, thereby allowing more efficient matching and broadbanding of each feed. Another method is to alter the relative impedances of each side of the antenna by changing the track width, or wire diameter, or numbers of tracks or wires.

Figure 3:
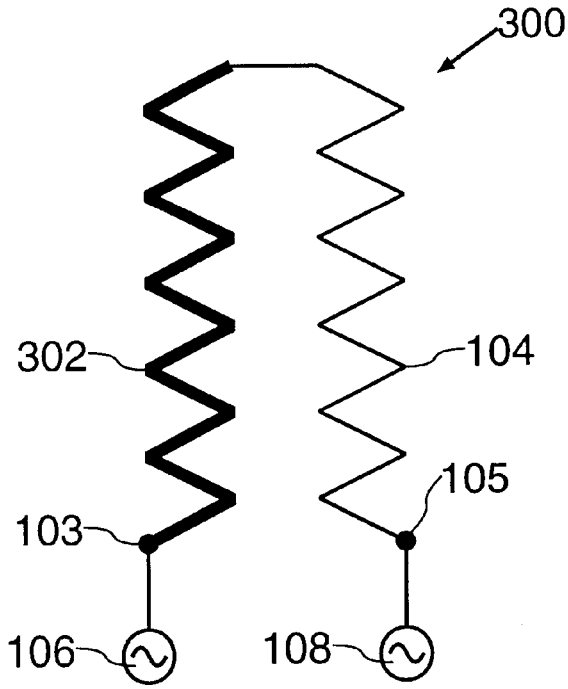
FIG. 3 shows an antenna arrangement having sections of different impedance, provided by variations to track width, in accordance with the present invention.

FIG. 3 shows an embodiment of an antenna 300 in which a wider track is used for a first section 302 while the width of the second section 104 is unchanged The impedance presented at the first feed point 103 is therefore reduced relative to that at the second feed point 105. Hence, in a transceiver the first feed 103 could be connected to a transmitter power amplifier and the second feed 105 to a receiver low noise amplifier, thereby providing improved operating conditions.

Figure 4:
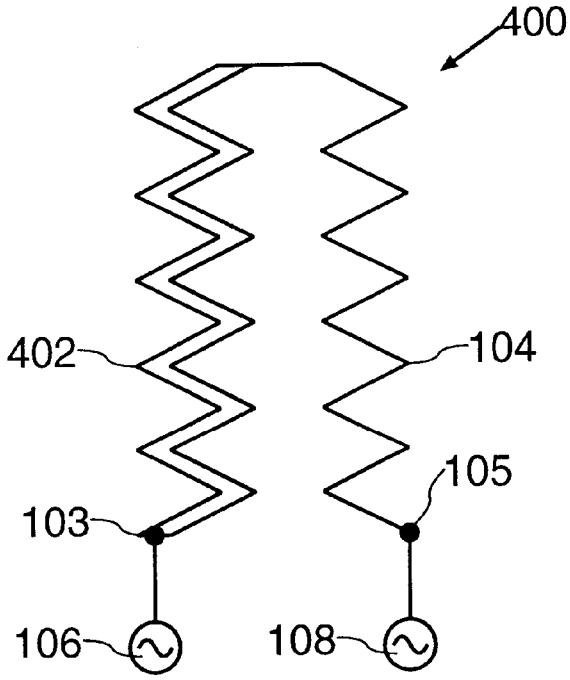
FIG. 4 shows an antenna arrangement having sections of different impedance, provided by incorporation of additional tracks in accordance with the present invention.

FIG. 4 shows an alternative embodiment of an antenna 400 in which two tracks 402 in parallel are used for a first section, similarly presenting a reduced impedance at the first feed point 103 compared to the second feed point 105. Clearly a wide range of variations are possible, tailored to particular requirements of a given application.

Figure 5:
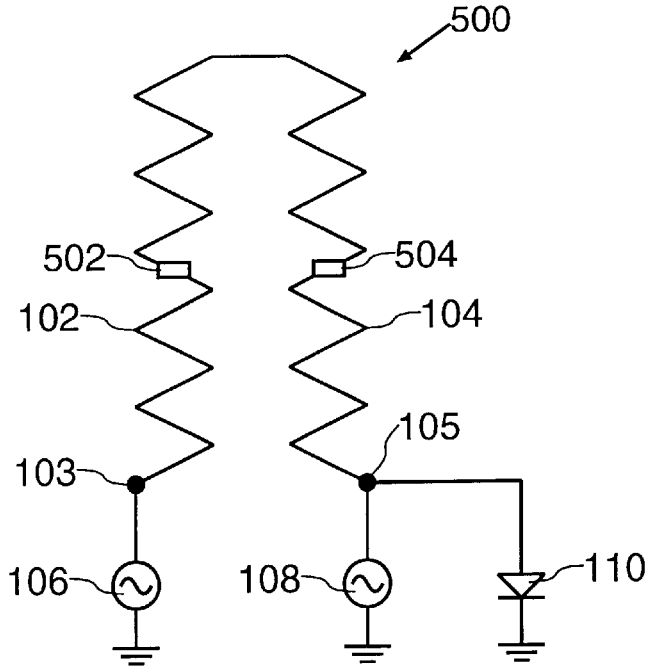
FIG. 5 shows an antenna arrangement incorporating discrete components in accordance with the present invention.

A further advantage of an antenna which can easily be fabricated as a printed structure on a substrate such as, PCB (Printed Circuit Board), LTCC (Low Temperature Co-fired Ceramic) or similar is the possibility of including discrete components within the antenna structure. FIG. 5 shows an embodiment of an antenna 500 incorporating lumped passive components 502, 504 to vary the antenna current distribution Switching components could also be incorporated in the antenna structure, for example enabling multi-mode operation by switching parts of the antenna structure into and out of operation. FIG. 8 shows an example of a double-tuned antenna 600, based on the antenna of FIG. 1. The first and second sections 102, 104 are linked by a shunt switch 610 and are also linked to further meander-line sections 602, 604 by first and second series switches 612, 614.

Figure 6:
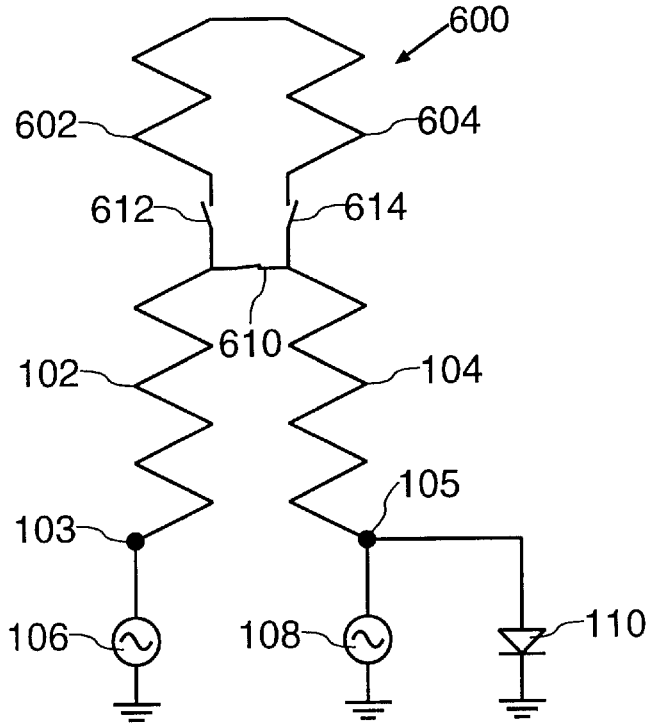
FIG. 6 shows a switched antenna arrangement in accordance with the present invention.

As shown in FIG. 6, the shunt switch 610 is closed and the series switches 612, 614 are open circuit, thereby switching the top portion of the antenna out of circuit. Reversing the state of all three switches routes current via the further sections 602, 604. Hence, dual band operation is enabled for an arbitrary pair of bands. The antenna 600 is therefor an electronic equivalent of an LC trap whip, where an LC resonant circuit alters the effective length of an antenna at its resonant frequency. Further switches could be used to enable multi-band operation, as well as to vary the impedance of the antenna in the same manner as provided (without switching capability) by short circuit track 204 of FIG. 2. Such switching could also be used to switch other discrete components into and out of circuit.

Figure 7:
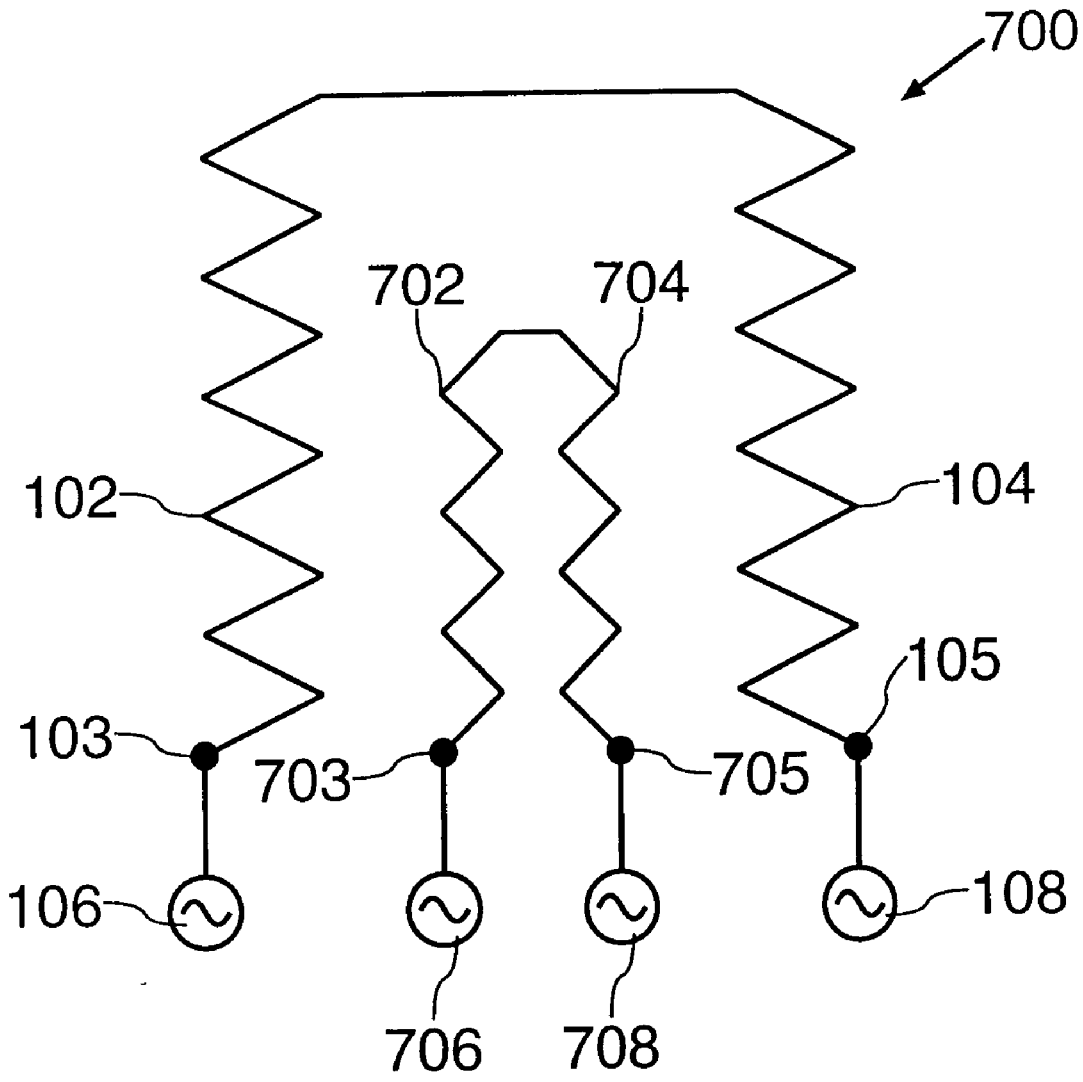
FIG. 7 shows a multiband antenna arrangement in accordance with the present invention.

The switched 610, 612, 614 can be implemented using any suitable components. These include diodes as well as more recent developments such as Micro ElectroMagnetic Systems (MEMS) switches. MEMS can also be used as variable capacitors without the non-linearity problems associated with conventional variable capacitors FIG. 7 shows another embodiment, in which a multi-band antenna 700 is obtained by duplicating the antenna structure with minimal change in volume. In addition to the first folded meander line, comprising first and second sections 102, 104, the antenna 700 comprises a further folded meander line, comprising third and fourth sections 702, 704 and third and fourth feed points 706, 708. The configuration illustrated is operable in four bands. If the further meander line was printed on a different layer or side of the substrate, it could even overlap with the first meander line. If a smaller number of feeding points was required, the first and third feed points 103, 703 could be combined, or the second and fourth feed points 105, 705, or both sets of feed points.

All of the above techniques can readily be combined, to enable the design of low-volume antennas suitable for a wide range of applications.

Although the embodiments described above relate to a folded monopole, in which each of the sections 102, 104 has an axis comprising a single straight line, other structures are possible, for example an 'L' shape. The only restriction is that the sections 102, 104 follow a sufficiently similar path to define a transmission line, typically by being substantially parallel.

The embodiments of the present invention described above use a meander-line antenna 100. However, other types of physically-shortened electric antennas could be used instead. Such antennas are monopole or dipole-like antennas that are physically smaller than their electrical length, and receive predominantly the electric field. An example of such an alternative antenna is a helical antenna.

From reading the present disclosure, other modifications will be apparent to persons skilled in the art. Such modifications may involve other features which are already known in the design, manufacture and use of antenna arrangements and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

What is claimed is:

1. An antenna arrangement, comprising:

a first folded structure including a first section and a second section defining a first transmission line, wherein said first section includes a first physically-shortened electric element having a first free end and said second section includes a second physically-shortened electric element having a second free end;

a first feed point provided at said first free end of said first section to receive a first signal; and a second feed point provided at said second free end of said second section to a second signal.

2. The antenna arrangement as claimed in claim 1, wherein said first section and said second section are parallel.

3. The antenna arrangement as claimed in claim 1, wherein said first section and said second section are meander-line elements.

4. The antenna arrangement as claimed in claim 1, a switch for connecting a said first feed point to a ground.

5. The antenna arrangement as claimed in claim 1, said first folded structure further includes a top load between said first section and said second section.

6. The antenna arrangement as claimed in claim 1, further comprising:

a short circuit between said first section and said second section.

7. The antenna arrangement as claimed in claim 6, wherein said short circuit includes a switch.

8. The antenna arrangement as claimed in claim 1, wherein said first section includes a first conductor of a first width, said second section includes a second conductor of a second width, and the first width and the second width are dissimilar.

9. The antenna arrangement as claimed in claim 1, wherein said first section includes a plurality of conductors in parallel.

10. The antenna arrangement as claimed in claim 1, wherein said first section includes at least on discrete component.

11. The antenna arrangement as claimed in claim 1, wherein said first section includes a switch.

12. The antenna arrangement as claimed in claim 1, further comprising:

a second folded structure including a third section and a fourth section defining a second transmission line, wherein said third section includes a third physically-shortened electric element having a third free end and said fourth section includes a fourth physically-shortened electric element having a fourth free end;

a third feed point provided at said third free end of said third section to receive a third signal; and a fourth feed point provided at said fourth free end of said fourth section to a fourth signal.

13. A radio communication apparatus including an antenna arrangement as claimed in claim 1.

14. The antenna arrangement as claimed in claim 1, further comprising:

a first signal source for feeding the first signal to said first free end;

a second signal source for feeding the second signal to said second free end.

15. The antenna arrangement as claimed in claim 14, wherein said first signal source is connected to a ground whenever said second signal source is actively feeding the second signal to said second free end.

16. The antenna arrangement as claimed in claim 15, wherein said second signal source is connected to the ground whenever said first signal source is actively feeding the first signal to said first free end.

* * * * *